United States Patent [19]

Favors

[11] Patent Number: 4,928,101

[45] Date of Patent: May 22, 1990

[54] ANTI-COLLISION SENSOR

[76] Inventor: Alexander L. Favors, 70 Creek Rd., Chalfont, Pa. 18914

[21] Appl. No.: 394,393

[22] Filed: Aug. 15, 1989

[51] Int. Cl.[5] ..... G08G 1/04

[52] U.S. Cl. ..... 340/943; 367/909; 364/461

[58] Field of Search ..... 340/903, 942, 943, 935, 340/436; 367/909; 250/221, 222.2; 364/461

[56] References Cited

U.S. PATENT DOCUMENTS

| | | | |
|---|---|---|---|
| Re. 32,252 | 9/1986 | Kay . | |
| 2,382,557 | 8/1945 | Frazier . | |
| 2,951,248 | 8/1960 | Goodell . | |
| 3,680,085 | 7/1972 | Del Signore . | |
| 3,681,750 | 8/1972 | Larka . | |
| 3,839,717 | 10/1974 | Paul . | |
| 4,026,654 | 5/1977 | Beaurain . | |
| 4,029,176 | 6/1977 | Mills . | |
| 4,045,766 | 8/1977 | Iida et al. . | |
| 4,103,278 | 7/1978 | Satake et al. . | |
| 4,240,152 | 12/1980 | Duncan et al. | 367/909 X |
| 4,278,962 | 7/1981 | Lin | 367/909 X |
| 4,551,722 | 11/1985 | Tsuda et al. | 340/904 |
| 4,618,948 | 10/1986 | Sakakibara et al. | 340/904 X |
| 4,623,032 | 11/1986 | Kemmer | 340/904 X |
| 4,658,385 | 4/1987 | Tsuji | 367/909 X |
| 4,779,240 | 10/1988 | Dorr | 367/909 X |
| 4,803,488 | 2/1989 | Dombrowski | 367/909 X |
| 4,803,670 | 2/1989 | Chen | 367/909 X |

*Primary Examiner*—Joseph A. Orsino
*Assistant Examiner*—Jeffery A. Hofsass
*Attorney, Agent, or Firm*—Ferrill and Logan

[57] ABSTRACT

An ultrasonic anti-collision detection and warning system adapted to be attached to a corner for warning objects approaching an intersection. The invention comprises first ultrasonic detection means having a first ultrasonic emitter which periodically emits an ultrasonic pulse at a first frequency within a first field of range, and a first ultrasonic sensor which detects an echo of said ultrasonic pulse emitted at said first frequency; second ultrasonic detection means having a second ultrasonic emitter which periodically emits an ultrasonic pulse at a second frequency within a second field of range, and a second ultrasonic sensor which detects an echo of said ultrasonic pulse emitted at said second frequency; a flexible connecting means for connecting said first and second ultrasonic detection around said corner; processor means for determining when an object enters said first field of range based upon the time of an echo received by said first sensor means, said processor means further determining when an object enters said second field of range based upon the time of an echo received by said second sensor means, said processor outputting a signal when objects simultaneously enter said first and second fields of range; and warning means responsive to said signal for outputting a warning signal in said first and second fields of range.

11 Claims, 8 Drawing Sheets

ANTI-COLLISION SENSOR

FIELD OF THE INVENTION

The present invention is directed to devices which activate a warning signal when two on-coming vehicles approach a common point from two different directions. Specifically, the present invention is directed to a device which utilizes ultrasonic sensors to warn two oncoming vehicles approaching an intersection from two different directions.

BACKGROUND OF THE INVENTION

The present invention is directed to an ultrasonic device which activates both visual and audible warning signals when two on-coming vehicles approach a common point or intersection from different directions. More particularly, the present invention is directed to a novel ultrasonic sensing means which is utilized to detect and warn two oncoming vehicles or individuals approaching an intersection of an impending collision.

Each year, millions of dollars in lost man hours and property are caused by industrial accidents. Frequently, these accidents are caused when two vehicles or individuals approach an intersection at a ninety degree angle. Intersecting crosswalks and passageways are common in such workplaces as factories, warehouses, and indoor loading docks. Typically, these environments are noisy and utilize material transport apparatus. Indoor transport apparatus such as forklifts and the like operate by propane or electrical power, and are comparatively silent in operation. In addition, federal and state occupational safety and health regulations often require workers to wear earplugs and other hearing protection devices. Accordingly, it is often difficult in industrial environments to hear an approaching or oncoming forklift or other indoor vehicle. This is a major cause of industrial collisions.

Previously, large convex mirrors have been utilized at intersections in the workplace to provide two-way vision between oncoming vehicles. While such mirrors provided a measure of safety, they have several shortcomings. First, they are typically mounted at a high location within the respective crosswalk and are often difficult to see. More importantly, because these mirrors are typically convex, they distort distances and often do not identify clearly the respective oncoming objects until both objects are too near to prevent a collision.

Various successful attempts have been made to utilize ultrasonic and acoustical sensors to identify objects or obstacles. Most of these prior art approaches have been utilized in automotive applications such as U.S. Pat. No. 3,681,750 to Larka, and U.S. Pat. No. 4,278,962 to Lin. Others have been utilized in avionic applications such as in U.S. Pat. No. 2,951,248 to Goodell. Finally several patents have been directed toward controlling the activation of doors such as U. S. Pat. Nos. 4,029,176 to Mills.

Because of their adaptability to object identification, it would be desireable to provide a light, compact, and easily attachable ultrasonic based warning device to provide a sound and warning light to prevent collisions at intersections in closely confined industrial areas such as warehouses, factories and the like.

It would also be desirable to provide an ultrasonic based signalling apparatus which will signal two objects entering a blind intersection at a 90° angle.

It would be further desirable to provide a device which can be easily placed at a corner and which utilizes ultrasonic signalling to warn on-coming objects approaching a corner of an impending collision.

It is therefore an object of the present invention to provide an ultrasonic sensing mechanism which will notify oncoming vehicles approaching at 90° or other acute or obtuse angles of an impending collision.

It is a further object of the present invention to provide a collision warning device which can be simply attached to a corner.

It is a further object of the present invention to provide an anti-collision device with a flexible pleated connection means which permits the device to be folded and detached with respect to any corner.

It is a further object of the present invention to provide an ultrasonic anti-collision sensor which is controlled by a micro processor and which emits both flashing light and audible warning signals.

SUMMARY OF THE INVENTION

In accordance with the present invention, an ultrasonic anti-collision detection and warning system adapted to be attached to a corner for warning objects approaching an intersection. The invention comprises first ultrasonic detection means having a first ultrasonic emitter which periodically emits an ultrasonic pulse at a first frequency in a first field of range, and a first ultrasonic sensor which detects an echo of said ultrasonic pulse emitted at said first frequency; second ultrasonic detection means having a second ultrasonic emitter which periodically emits an ultrasonic pulse at a second frequency in a second field of range, and a second ultrasonic sensor which detects an echo of said ultrasonic pulse emitted at said second frequency; a flexible connecting means for connecting said first and second ultrasonic detection around said corner; processor means for determining when an object enters said first field of range based upon the time of an echo received by said first sensor means, said processor means further determining when an object enters said second field of range based upon the time of an echo received by said second sensor means, said processor outputting a signal when objects simultaneously enter said first and second fields of range; and warning means responsive to said signal for outputting a warning in said first and second fields of range.

BRIEF DESCRIPTION OF THE DRAWINGS

The foregoing summary as well as following detailed description will better be understood when read in conjunction with the drawings appended hereto. For the purpose of illustrating, they were shown in the drawings and embodiment which is presently preferred, it being understood, however, that this invention is not limited to the precise arrangement and instrumentalities shown.

DETAILED DESCRIPTION OF THE PRESENT INVENTION

The present invention is described with reference to the enclosed figures wherein the same numbers are used where applicable.

Figure 1:
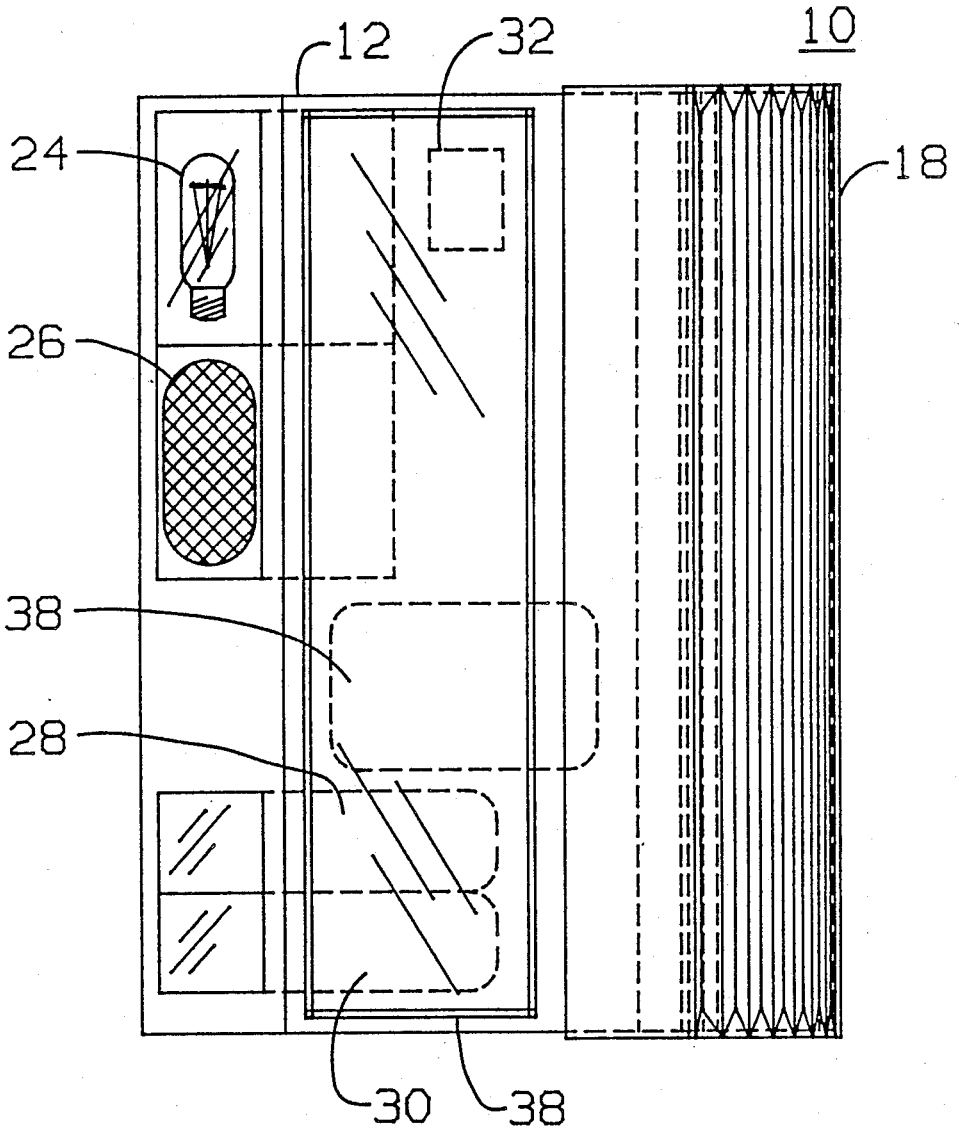
FIG. 1 is a left side projection view of the anti-collision sensor of the present invention from a first perspective.
Figure 2:
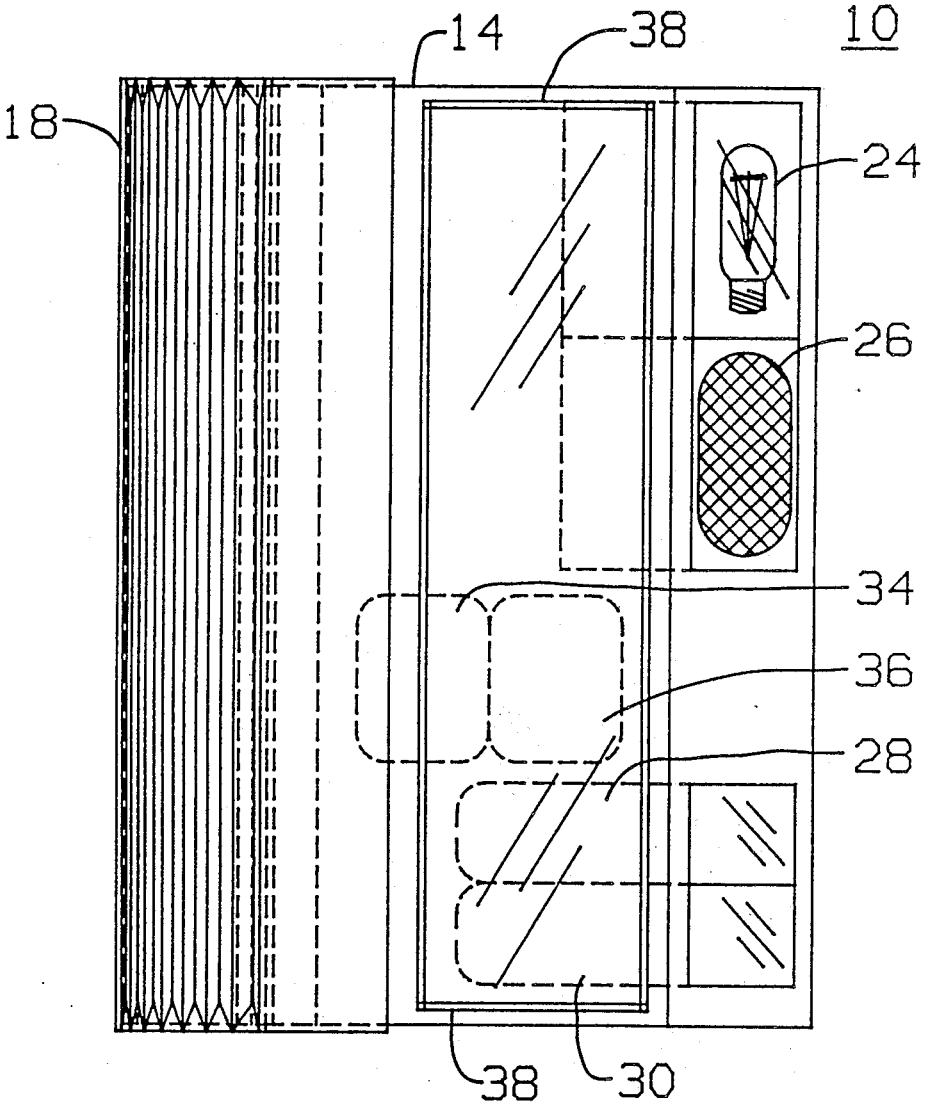
FIG. 2 is a right side projection view of the anti-collision of the present invention from a second perspective.

Referring to FIGS. 1–4, the anti-collision sensor of the present invention is described. Referring to FIGS. 1 and 2, the anti-collision sensor 10 of the present invention is shown. The invention comprises two ultrasonic sensing units 12, 14 separated by a flexible pleated corner. The sensing units 12, 14 comprise two rectangular plastic casings which fit around respective sides a corner wall 16. The individual sensor units 12, 14 are folded with respect to a flexible pleated connector 18 and are attached directly to the corner by an adhesive 20, screws or other suitable attachment device.

In the preferred embodiment, the flexible connector 18 comprises a pleated plastic connector. The connector permits the flexible attachment of the device and also permits internal wires to extend between the units. While the present invention is illustrated as being attached to a ninety degree corner, it is to be appreciated that the flexible connector enables the device to be attached to a corner having any angular configuration.

Figure 3:
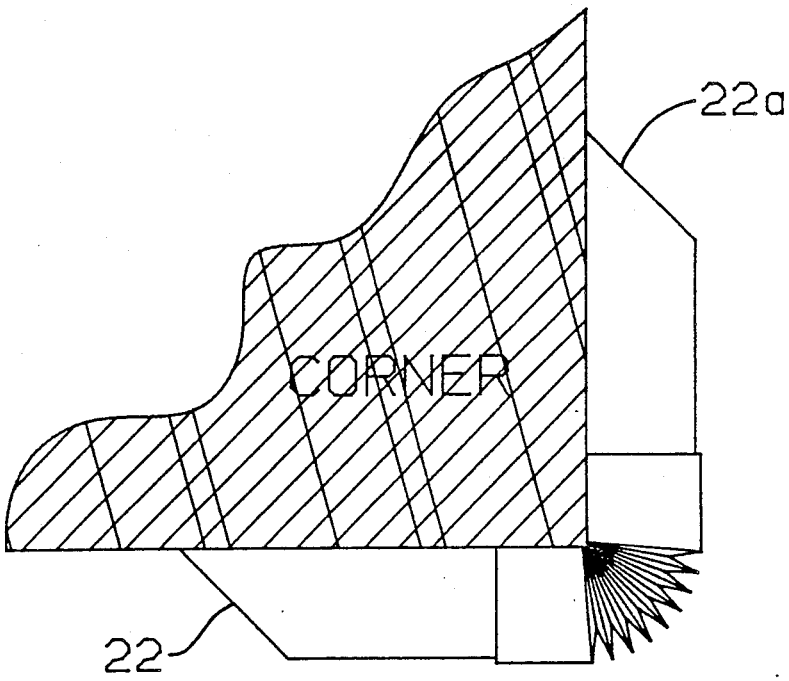
FIG. 3 is a plan view of the anti-collision sensor of the present invention.

Each sensor has a beveled side edge 22, 22*a* which contains an alarm signal light 24, an alarm sound signal 26 and ultrasonic emitter 28 and sensor 30. The operation of the sensing device will be explained in greater detail herein. Referring to FIGS. 1 and 3, the mechanism is activated by a switch 32. The unit contains an internal central processing unit 34. The central processing unit 34 operates pursuant to a program algorithm which controls the device, and which is prestored in a programmable memory device 36 such as a ROM or PROM.

Figure 4:
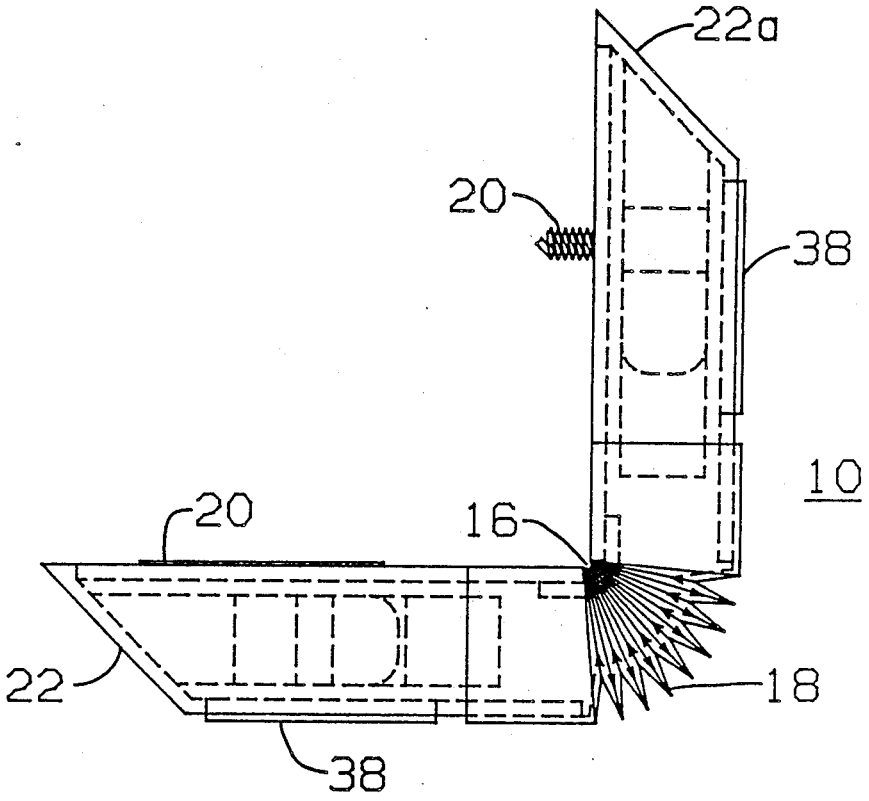
FIG. 4 is a broken-away plan view of the anti-collision sensor of the present invention.
Figure 5:
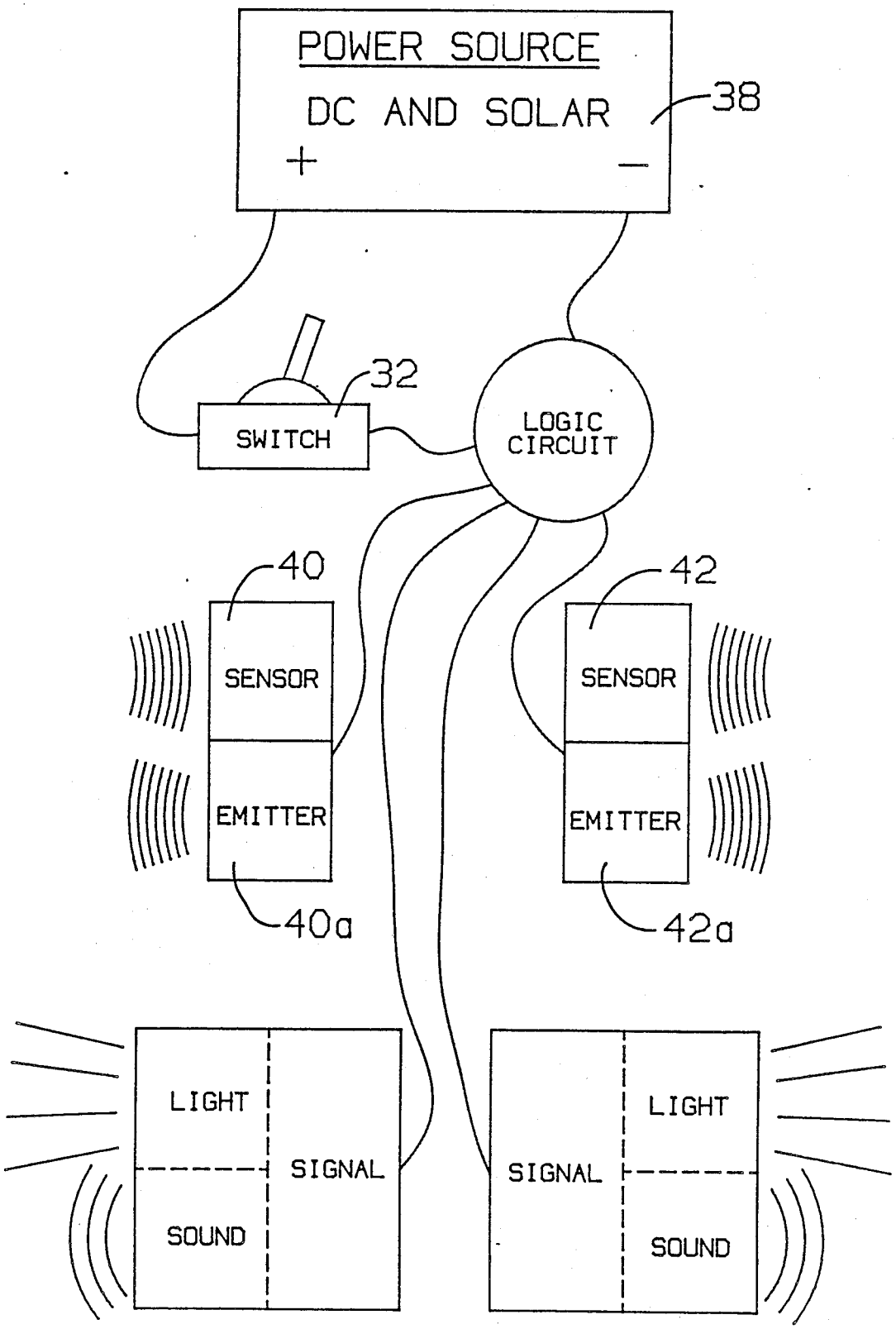
FIG. 5 is a block diagram of the control system of the present invention.

Referring to the block diagram of FIG. 5, the device may be powered by either a solar cell or a DC power source 38. As shown in FIG. 4, the circuit includes two warning lights as well as two signalling sounders for each sensing unit 12, 14. As shown, the circuit also incorporates the two sets of ultrasonic emitters and receivers 40, 40*a*, 42, 42*a*.

The present invention is intended to be utilized with a pulse-echo ultrasonic system. Ultrasonic sensing systems operate on the principles that sound waves reflect or echo, and that the speed of a sound wave through air is discretely measurable. Because the speed of sound through air is a relative constant (assuming constant factors such as humidity and wind speed), the time between an ultrasonic pulse and echo can be measured. The time measurement is made by pulsing the transmitter and measuring the time interval between the transmitted pulse and the received echo. For example, the velocity of sound is approximately 335 meters per second. The echo from a target five meters away will arrive in 29 milliseconds after emission of the transmitted pulse.

Ultrasonic systems operate in a frequency range of between 20 and 70 KHZ. While the present invention may be utilized with a variety of ultrasonic transducer, a typical transducer which may be utilized in the present invention is a Polaroid Corporation type ultrasonic transducer which produces a conical ultrasonic beam at about 50 KHZ that is approximately 10 degrees wide. The ultrasonic emitters of the present invention should have an effective operating range of between 10 and 12 feet.

Figure 6:
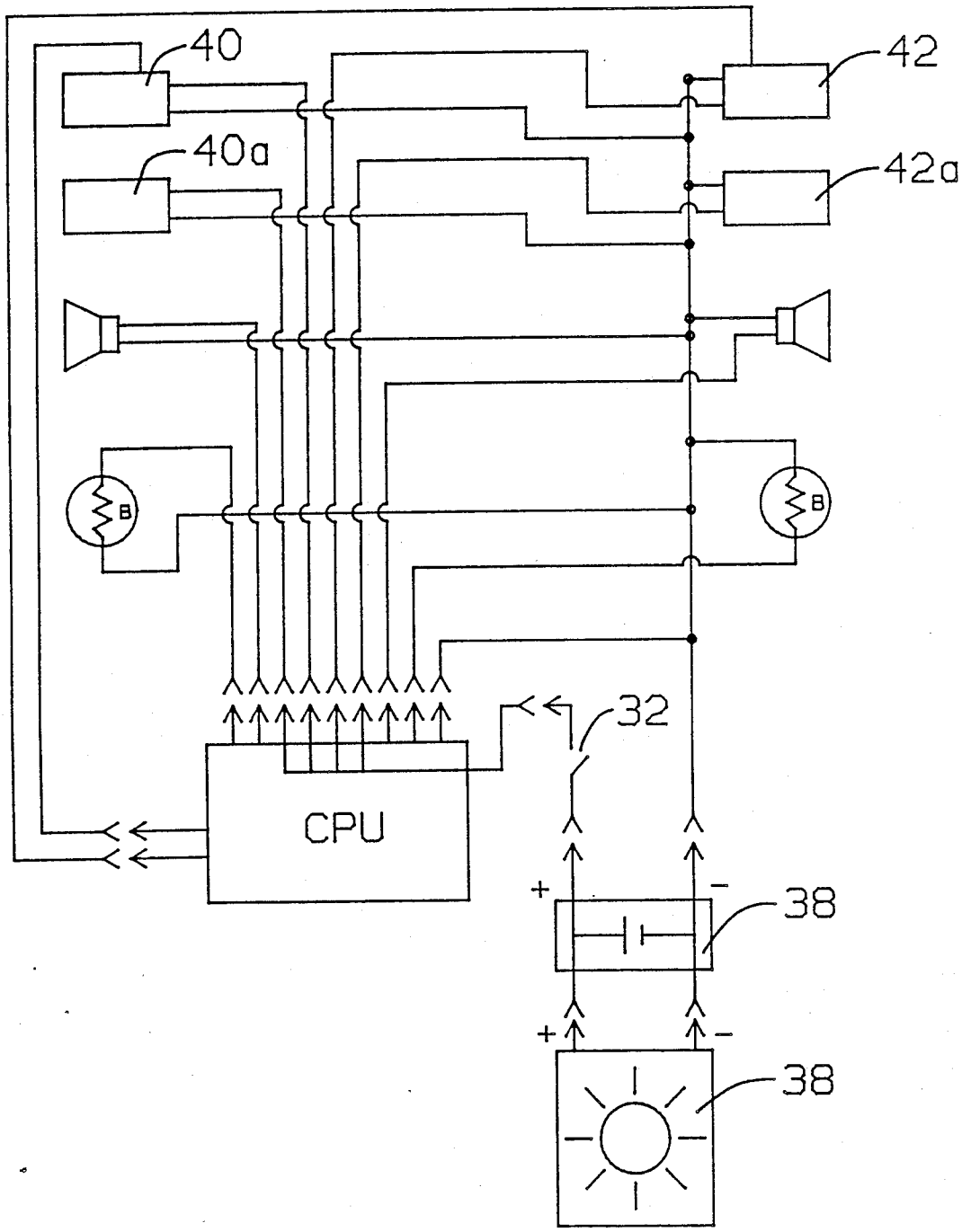
FIG. 6 is a flow chart diagram of the anti-collision sensor for the present invention.

The block diagram of FIG. 5 is more particularly shown in the schematic of FIG. 6. As shown, the system is powered by DC or solar power supply 38. The central processing unit is in series with the pairs of ultrasonic emitters and sensors 40, 40*a*, 42, 42*a*, and each sensor unit 12, 14 has an alarm light and horn.

In operation, the detection unit is preferably placed at the desired corner at a height of between 0 to 12 feet from the ground. The sensor may be attached by the adhesive 20 or other attachment device. The device is then activated by turning on the switch 32. The device then operates in accordance with the prestored algorithm.

Figure 7:
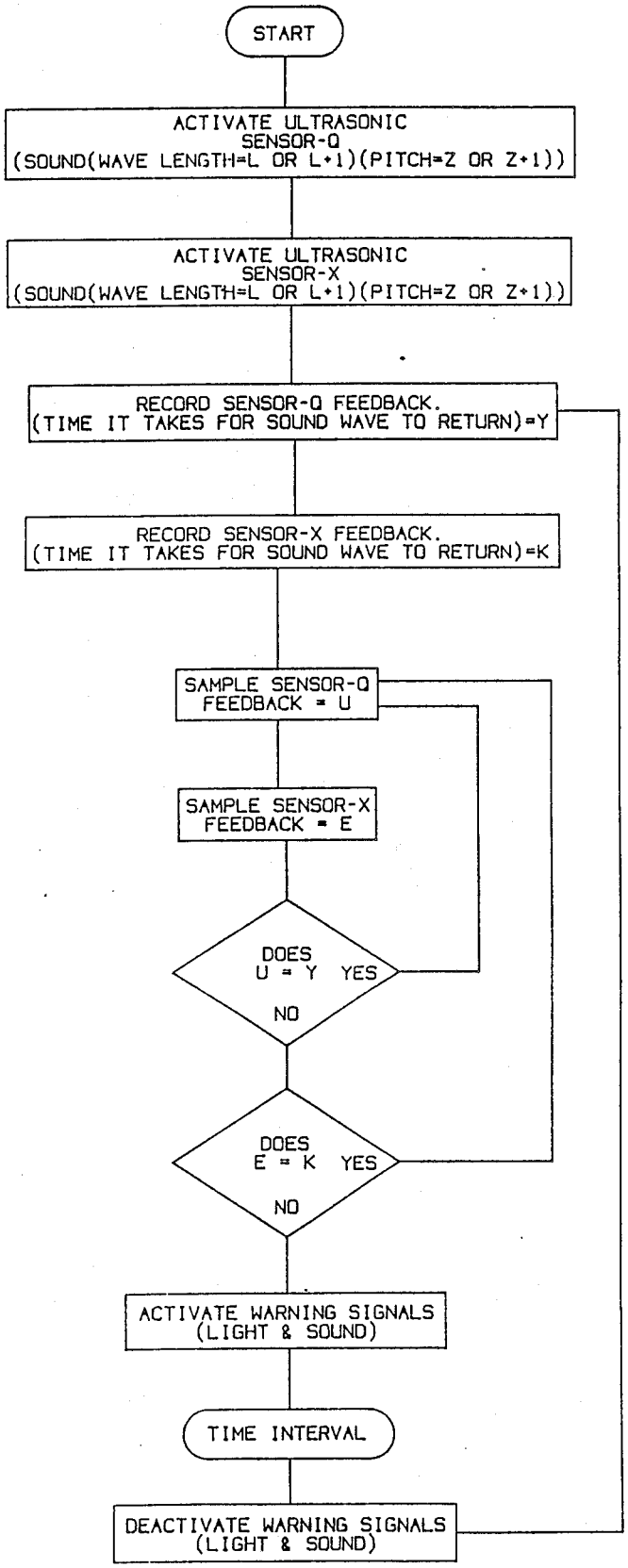
FIG. 7 is an algorithmic flow chart which illustrates the flow logic for the present invention.
Figure 8:
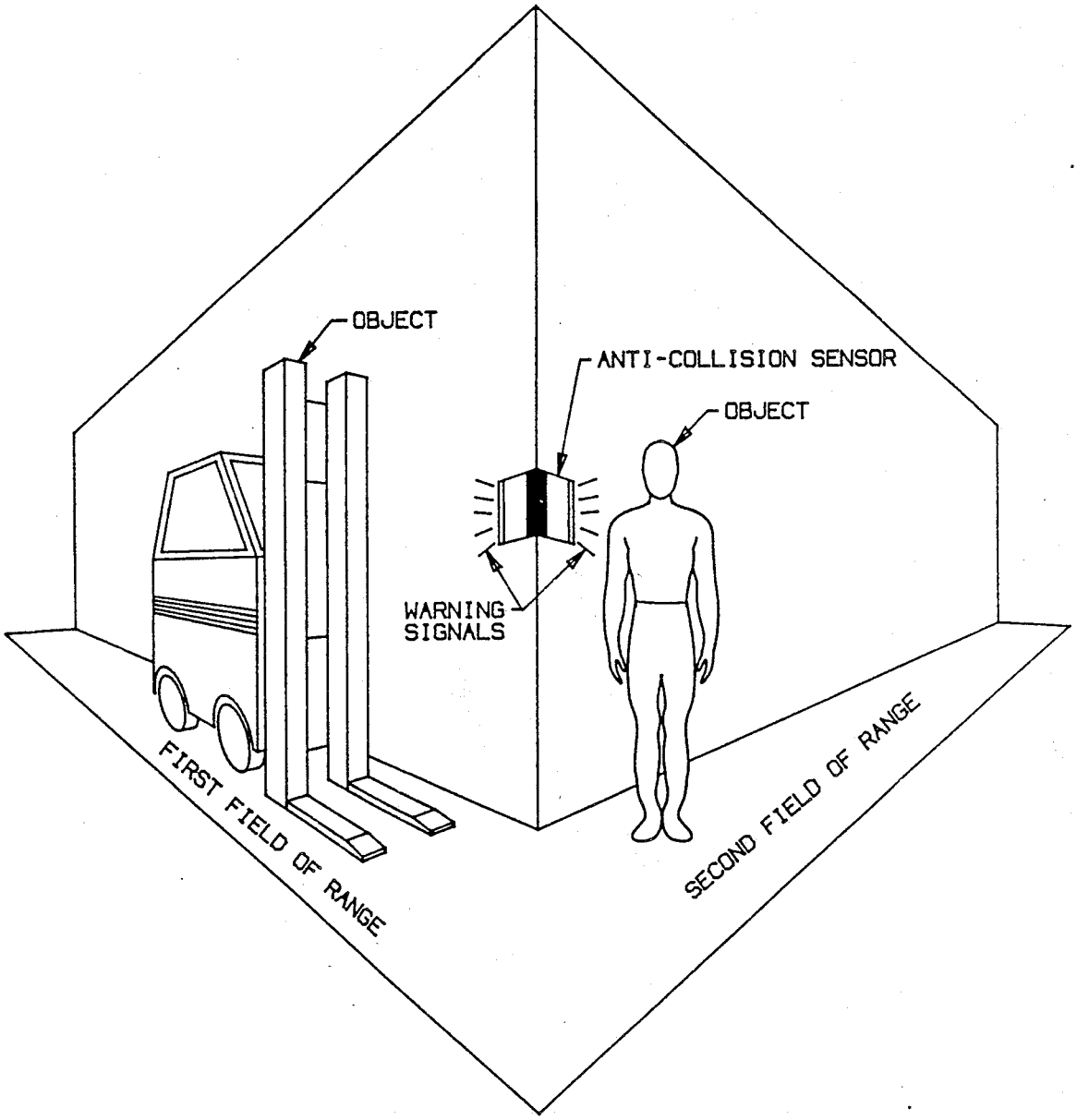
FIG. 8 is a perspective view of the anti-collision sensor mounted on a corner at a typical intersection.

The algorithm for the preferred embodiment is now described with reference to the flow chart of FIG. 7. Referring to the algorithm, the power for the ultrasonic sensors is activated by power supply 38. Each sensor unit 12, 14 (designated Q and X) operates at a different frequency so as to prevent accidental activation. An initial pulse echo is taken for each sensor and prestored in memory as variables Y and K. Next, the respective sensors take pulse-echo measurements which are stored as variable U for the Q sensor and variable E for the X sensor. Next, U is compared to Y and E is compared to K. If both U and E do not equal Y and K, respectively, corresponding to the presence of two objects within the field of range of the sensors, the microprocessor activates the warning lights and horn. After a preset interval, the system resets. If no objects or only one object is within the field of range of either of the sensors the program loops and continues to sample. Thus, the present device continually samples two fields of range. As shown in FIG. 8, when two objects simultaneously enter the first and second fields of range, the respective warning signals are activated.

While the present invention has been described with reference to a preferred embodiment, it is to appreciated by those skilled in the art that other embodiments fall within the spirit and scope of the present invention and that the true scope of the present invention is to be determined with reference to the claims appended hereto.

What is claimed is:

1. An ultrasonic anti-collision detection and warning system adapted to be attached to a corner for warning objects converging on an intersection from different directions comprising:

first ultrasonic detection means having a first ultrasonic emitter means which periodically emits an ultrasonic pulse at a first frequency within a first field of range, and a first ultrasonic sensor means which detects an echo of said ultrasonic pulse emitted at said first frequency;

second ultrasonic detection means having a second ultrasonic emitter means which periodically emits an ultrasonic pulse at a second frequency within a second field of range, and a second ultrasonic sensor means which detects an echo of said ultrasonic pulse emitted at said second frequency;

flexible connecting means for connecting said first and second ultrasonic detection means around said corner;

processor means for determining when an object enters said first field of range based upon the time an ultrasonic echo is received by said first sensor means off of said object, said processor means further determining when an object enters said second field of range based upon the time of an ultrasonic echo received by said second sensor means off of said object, said processor means outputting a signal when objects simultaneously enter said first and second fields of range; and alarm means responsive to said signal for outputting a warning signal in said first and second fields of range when objects are simultaneously within said first and second fields of range.

2. The ultrasonic anti-collision detection and warning system of claim 1 wherein said system is powered by a solar cell.

3. The ultrasonic anti-collision detection and warning system of claim 1 wherein said system is powered by a DC power source.

4. The ultrasonic anti-collision detection and warning system of claim 1 further comprising attachment means for attaching said device to a corner.

5. The ultrasonic anti-collision detection and warning system of claim 1 wherein said attachment means is an adhesive strip.

6. The ultrasonic anti-collision detection and warning system of claim 1 wherein said connecting means comprises a flexible pleated connector.

7. The ultrasonic anti-collision detection and warning system of claim 1 wherein said alarm signal means comprises a flashing light and horn.

8. An ultrasonic anti-collision detection and warning system adapted to be attached to a corner for warning objects approaching an intersection comprising:

first ultrasonic detection means having a first ultrasonic emitter means which periodically emits an ultrasonic pulse at a first frequency within a first field of range, and a first ultrasonic sensor means which detects an echo of said ultrasonic pulse emitted at said first frequency;

second ultrasonic detection means having a second ultrasonic emitter means which periodically emits an ultrasonic pulse at a second frequency within a second field of range, and a second ultrasonic sensor means which detects an echo of said ultrasonic pulse emitted at said second frequency;

pleated flexible connecting means for connecting said first and second ultrasonic detection means around said corner;

processor means for determining in accordance with a prestored algorithm when an object enters said first field of range based upon the time of the ultrasonic echo received by said first sensor means, and further determining in accordance with said prestored algorithm when an object enters said second field of range based upon the time of the ultrasonic echo received by said second sensor means, said processor means outputting a signal when objects simultaneously enter said first and second fields of range; and alarm means responsive to said signal for outputting a warning signal in said first and second fields of range.

9. The ultrasonic anti-collision detection and warning system of claim 8 wherein said algorithm is pre-stored in a programable memory.

10. The ultrasonic anti-collision detection and warning system of claim 8 wherein said corner has an obtuse angle.

11. The ultrasonic anti-collision detection and warning system of claim 8 wherein said corner has an acute angle.

* * * * *

UNITED STATES PATENT AND TRADEMARK OFFICE

CERTIFICATE OF CORRECTION

PATENT NO. : 4,928,101

DATED : May 22, 1990

INVENTOR(S) : Alexander L. Favors

It is certified that error appears in the above-identified patent and that said Letters Patent is hereby corrected as shown below:

Col. 3, line 67 - "transducer," should be --transducers,--

Signed and Sealed this

Ninth Day of July, 1991

*Attest:*

HARRY F. MANBECK, JR.

*Attesting Officer*

*Commissioner of Patents and Trademarks*